US007941875B1

(12) United States Patent
Doctor et al.

(10) Patent No.: US 7,941,875 B1
(45) Date of Patent: May 17, 2011

(54) TRABECULAR MATRIX LIKE PROTECTORS AND METHOD

(75) Inventors: David G. Doctor, Ware, MA (US); Ivan E. Brown, Spirit Lake, IA (US)

(73) Assignee: Brown Medical Industries, Spirit Lake, IA (US)

( * ) Notice: Subject to any disclaimer, the term of this patent is extended or adjusted under 35 U.S.C. 154(b) by 740 days.

(21) Appl. No.: 11/363,077

(22) Filed: Feb. 27, 2006

(51) Int. Cl.
*A41D 13/00* (2006.01)

(52) U.S. Cl. ..... 2/455

(58) Field of Classification Search ..... 2/22, 24, 2/455, 456, 69, 159, 16, 465
See application file for complete search history.

(56) References Cited

U.S. PATENT DOCUMENTS

| | | | | |
|---|---|---|---|---|
| 4,535,553 | A * | 8/1985 | Derderian et al. | 36/28 |
| 5,599,290 | A * | 2/1997 | Hayes et al. | 602/61 |
| 5,738,939 | A * | 4/1998 | Calhoun et al. | 428/343 |
| 6,093,468 | A * | 7/2000 | Toms et al. | 428/67 |
| 6,186,906 | B1 * | 2/2001 | Sullivan et al. | 473/351 |
| 6,383,519 | B1 * | 5/2002 | Sapieszko et al. | 424/489 |
| 6,408,446 | B1 * | 6/2002 | Carrington | 2/465 |
| 6,626,950 | B2 * | 9/2003 | Brown et al. | 623/23.72 |
| 6,867,253 | B1 * | 3/2005 | Chen | 524/505 |
| 7,020,988 | B1 * | 4/2006 | Holden et al. | 36/35 B |
| 7,058,989 | B2 * | 6/2006 | Domingos | 2/412 |
| 7,067,583 | B2 * | 6/2006 | Chen | 525/89 |
| 7,100,216 | B2 * | 9/2006 | Matechen et al. | 2/455 |

* cited by examiner

*Primary Examiner* — Tejash Patel
(74) *Attorney, Agent, or Firm* — McKee, Voorhees & Sease, P.L.C.

(57) ABSTRACT

An impact pad containing body cushioning device with the impact pad filled with a viscoelastic polymeric material which mimics the trabecular architecture of cancellous bone allowing the device to enhance this ability to cushion impact forces against various sensitive parts of the human body.

16 Claims, 7 Drawing Sheets

TRABECULAR MATRIX LIKE PROTECTORS AND METHOD

FIELD OF THE INVENTION

This invention relates to orthotic devices, particularly impact pad cushioning devices for cushioning impact forces that collide with impact sensitive parts of the human body.

BACKGROUND OF THE INVENTION

Wrist fractures and hip fractures are perhaps some of the most common skeletal site injuries of humans. For example, wrist fractures have an incidence of about 1 in 500 for the general population and hip fractures, particularly amongst elderly Americans, are common. As a further indicia of the commonality of hip fractures amongst older Americans, in the year 2000 more than 340,000 older Americans sustained hip fractures at a cost of nearly $20 billion. More than 90% of such hip fractures are associated with falls. These few statistics alone demonstrate the need for protective and preventive technology to avoid such fractures rather than have our country and its economy sustain the economics of post injury treatment.

Devices used as external protectors are of course known and have been used in the past for almost every sensitive area of the body from head to shoulder, to forearm, to wrist, to knee, to shin, to ankle, etc. Just to name a few examples of such devices: air bags, crash helmets, foam rubber dash boards, playground surfaces, track and field pits, athletic footwear with cushions, etc. To date, none of these devices as used have succeeded in developing a structure that equals the impact resistance ability of normal human bone. Put another way, the human skeleton is already optimized by nature to absorb impact. This is because of the physics involved. The skeleton seems to recognize almost a fact of physics, i.e., that if collision time is extended or increased the forces of impact will decrease. This implies that if there is some deformation of the impact surface before zero velocity is reached, the forces experienced will decrease. As a result, for example, we now have soft nosed cars, rather than the hard thick steel front ends of past days, for example, the 1930's and 1940's. However, this recognition that slow deformation decreases the forces of impact is one thing, putting this to use in making body part protectors, i.e., pads, is quite another thing.

The current design of energy absorbing orthotic devices uses a variety of foamed and/or microcellular thermoplastic materials known in the industry as thermoplastics (TP's) or thermoplastic electomers (TPE's), gels, etc. In orthopedic technology, these materials have been applied to the foot for use in orthotic and athletic footwear. However, no one has yet made a material paralleling the internal lattice-like structure called trabeculation with cells and fluids interspersed among the trabecula that occurs in human bone. The property of human bone referred to here is "viscoelastic properties". By viscoelastic we mean to define a material which has some of the properties of a solid, and some noncompressable properties of a fluid that demonstrates both viscous and elastic behavior under stress, which results in a continuous creep or displacement as force increases, resulting in an even greater resistance to motion.

Accordingly, it is a primary objective of the present invention to provide new orthotic devices and methods which employ viscoelastic polymeric materials in pads to provide a response to impact forces that mimics the trabeculator architecture response of human bone and the cells and fluid interspersed within the lattice-like structure of human bone. The orthotic devices for which the impact pad containing the viscoelastic polymer may be used are many and not intended to be limiting. Those include heel cushions, hip pads, bone spur pads, wrist pads, elbow pads, shoulder pads, thigh pads, forearm pads, head protectors and shin and ankle protectors, among others.

The method and manner of accomplishing the primary objective as well as others will become apparent from the detailed description of the invention which follows.

It is understood that minor changes and modifications that occur to one of skill in the art may be made and still fall within the scope and spirit of the invention.

BRIEF SUMMARY OF THE INVENTION

An impact pad containing orthotic device for cushioning body parts comprising a covering pad for placement in close proximity to body parts to be protected and a viscoelastic polymeric material placed within the pad which mimics the trabeculator architecture of cancellous bone. This results in an enhanced ability to resist impact forces with minimum fracture damage to the underlying human body structure.

Figure 1:
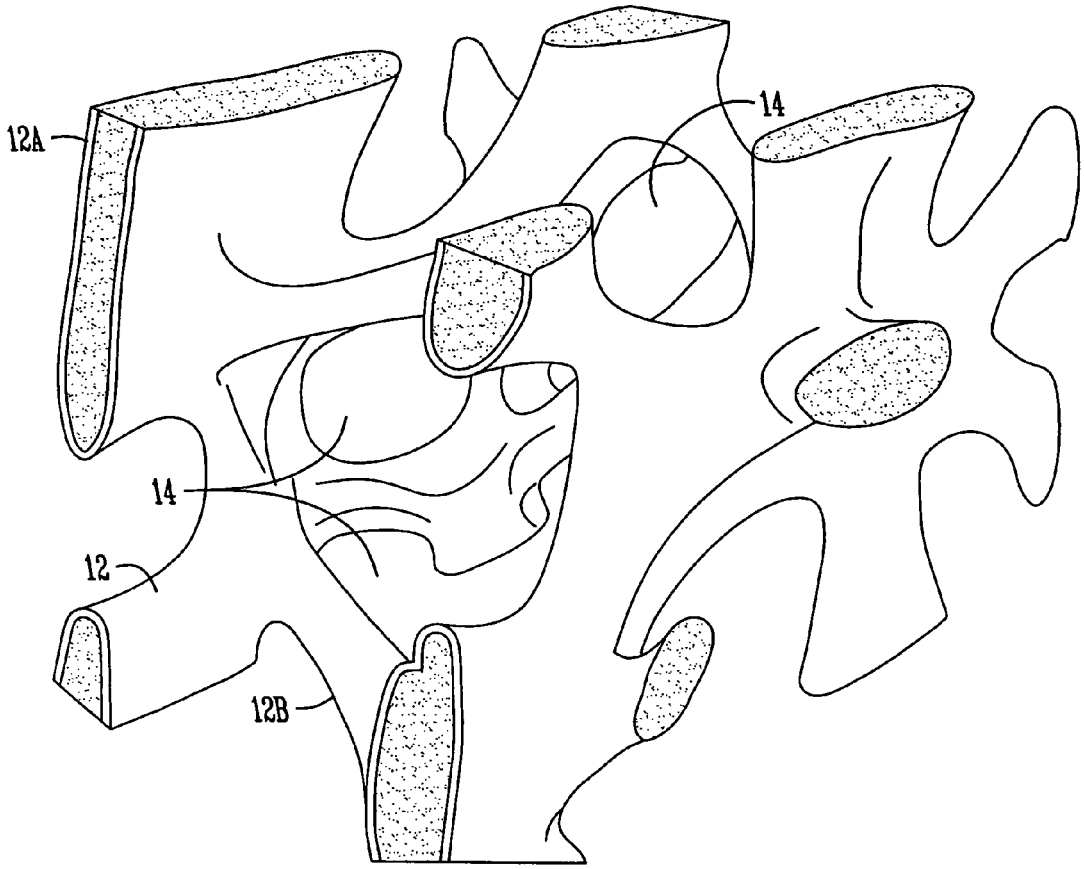
FIG. 1 is a three-dimensional drawing of the structure of trabecular bone.

Other orthotic devices besides those illustrated and described herein may as well be employed. The important point being that the viscoelastic polymeric material can be used as the padding in any orthotic device which is designed to cushion body parts against impact.

DETAILED DESCRIPTION OF A PREFERRED EMBODIMENT

Trabecular bone 12 has an internal lattice-like structure called trabeculation (see FIG. 1) with voids 14 for cells 16 and fluid 18 (FIG. 2) interspersed in it. When a constant load is applied, the bone 12 will continue to deform slowly not instantaneously as in the spring 20 (see FIG. 3) and furthermore as the rate of applied load 30 increases, the resistance increases (also see FIG. 3).

Figure 2:
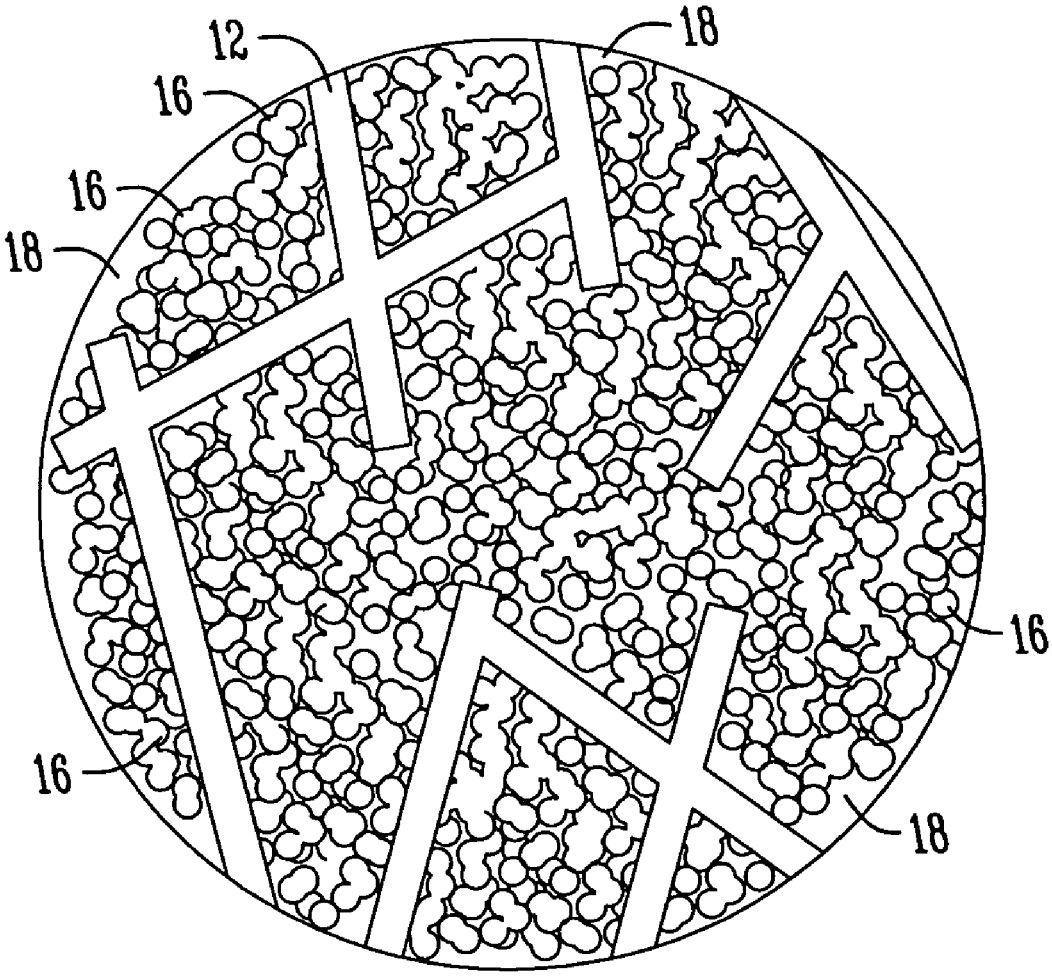
FIG. 2 shows in diagrammatic form a microscopic view of a cross-section of trabecular bone like FIG. 1 with the walls of the maze consisting of bone and the space in between representing cells and fluid.

FIG. 1 illustrates trabecular bone 12 wherein tiny plates 12(A) of the bone are interconnected with narrow boney struts 12(B). Cells 16 and fluid 18 flow through the spaces or voids 14, as illustrated in FIG. 2.

Figure 3:
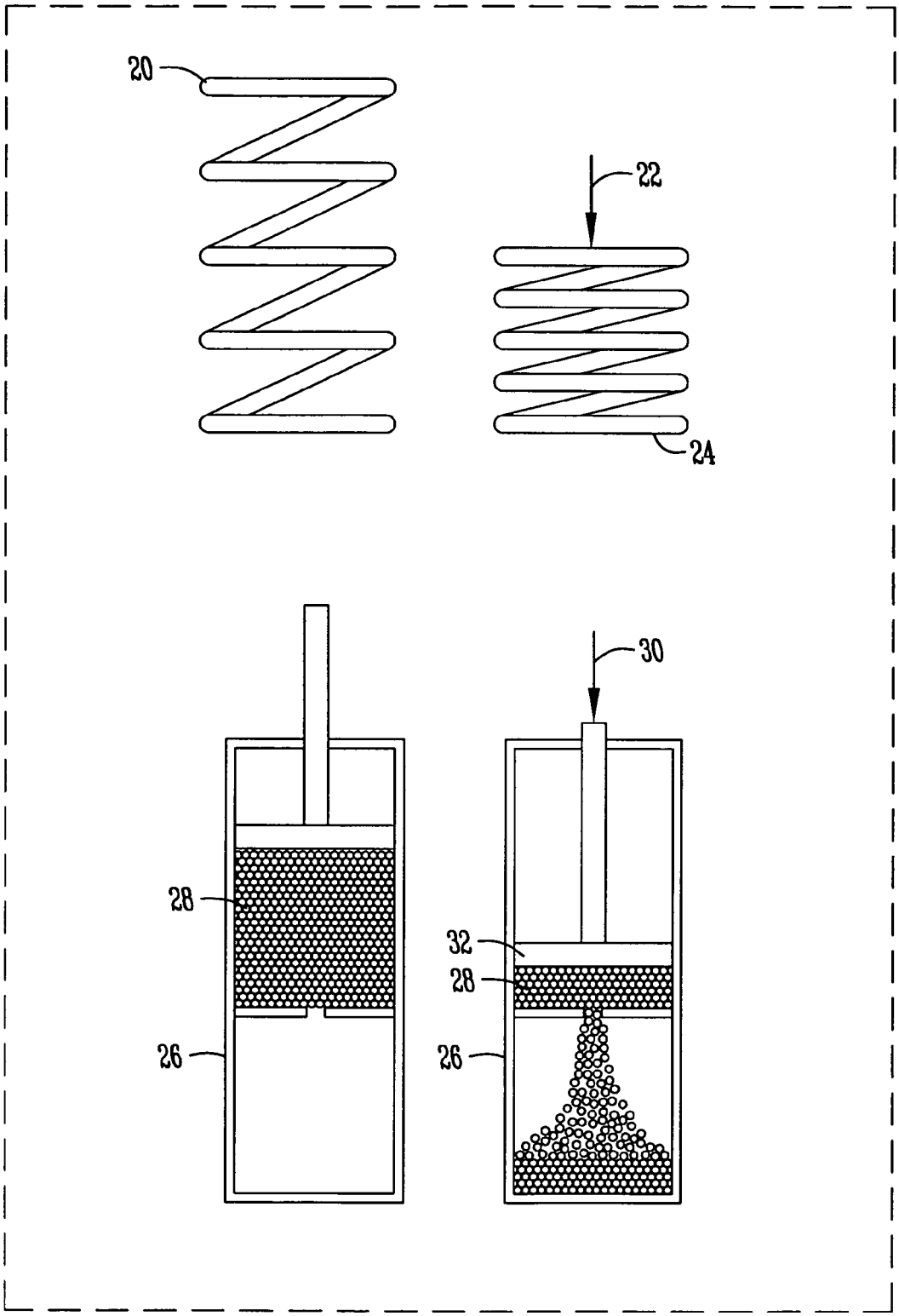
FIG. 3 is a diagram to illustrate the physics attributed to viscoelastic properties.

Upon impact trabecular bone 12 provides a viscoelastic response because of the combination of the maze-like structure of the bone 12 with its voids 14 to form an internal lattice-like structure filled with the cells 16 and fluid 18. Viscoelastic response is used herein as earlier defined. Briefly it can be illustrated using FIG. 3. The top portion of FIG. 3 shows spring 20 compressed with a downward force (arrow) 22. When the downward force represented by arrow 22 is applied to spring 20 and the force exceeds its elastic component, the spring 20 instantly compresses to the position represented at 24. Contrast this force illustration (top of FIG. 3) with the viscoelastics represented by the syringe illustration in the lower half of FIG. 3. The syringe 26 has a fluid 28 which is being forced through it. Loading the handle of the syringe 26 with a constant force 30 causes it to continue to creep or displace as illustrated at position 32 in contrast with the spring 20, which reaches a final displacement (see compressed spring 24). Further, if the force 30 is applied to the syringe 26 more rapidly, there is greater resistance to motion. This represents viscoelasticity, in contrast to the conventional cushioning forces as represented by the spring 20 and compressed spring 24. What normally happens in presently used orthotic devices with the padding material can be likened to what happens with the spring 20 as compressed to 24. What happens with viscoelastics that mimic the trabecular architecture of bone is more like what happens with the syringe 26 and the fluid 28 contained within it as described in FIG. 3.

The viscoelastic material which can be placed within the pad of the orthotic device can be selected from a variety of viscoelastic polymeric materials, including Sorbethane®, Supracor®, Confor® foam, Poron® (a cellular urethane), Micro-cell Puff®, a laminated version of Poron, polyurethanes, polyolisocyanates, polystyrenes, polyvinyls, certain polyvinyl acetates and poly-alpha-olefins. The precise polymeric material is not critical, as long as it is a compressible polymeric viscoelastic material which exhibits and/or mimics the trabecular architecture of cancellous bone. Certain of these polymeric materials are formed by mixing at least two and in some instances more monomer components. Their formation is well-known to those skilled in polymer arts and need not be generally described herein. For example, *The Condensed Chemical Dictionary* describes general preparation of many such polymeric materials useful herein. To make the material mimic viscoelastic properties it is essential that the polymerized material be formed in a manner which imparts voids 14 to it (see FIG. 1). Such can be done by performing a polymerizing step in a mold which forms the mixed monomer material into a random lattice structure shaped to allow the final polymer to mimic the random but yet uniform trabecular architecture of cancellous bone (see FIG. 1). Once the polymerization reaction is complete, the cavity shaping mold is removed and the polymerized material having the desired voids is removed. It is then useful as the viscoelastic polymeric material of the present invention for cutting, shaping and insertion into cushioning pads of orthotic devices.

A variety of polymeric materials were tested using a simple but effective egg-experiment. After the polymer material was formed an egg was taped onto a slab of material. This was then dropped vertically onto a concrete surface from a height of 40 inches, chosen arbitrarily as a height from which a wrist would be positioned at the start of a fall during, for example, snow-boarding activity. The polymer material as tested ranged in thickness from ⅛ inch to about ¾ inch. Those materials which survived without the egg breaking were tested further for effective use in injury reduction from a single impact force. When this egg drop test was used with the materials currently used in commonly available orthotics, such as for example wrist protectors, it revealed that those currently in use do not absorb the energy in the most ideal fashion, and in fact, only alter the injury pattern, as opposed to effectively functioning in a preventive manner. In contrast, the materials that passed this test which had viscoelastic properties provide maximum force dissipation in accordance with the proven physics of collision protection.

As a result of this observed phenomena, many orthotic devices such as earlier mentioned can be made and correspondingly applied to a variety of sports, team and individual uses, including football, snow boarding, roller blading, hockey, and almost any other kind of sport and its associated protectors. Examples of each device are illustrated below.

Figure 4:
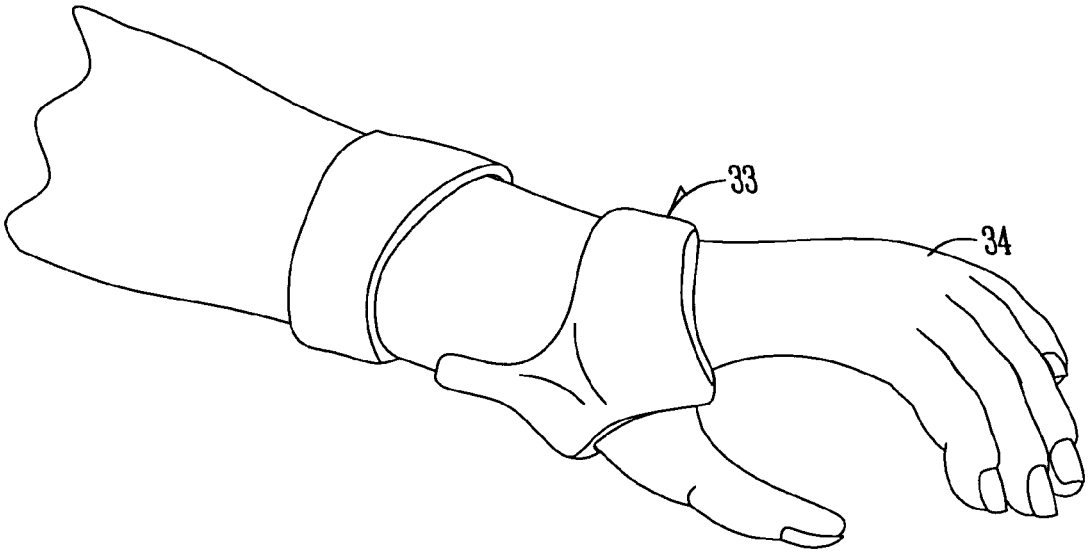
FIG. 4 is a perspective view of a wrist protector of this invention.
Figure 5:
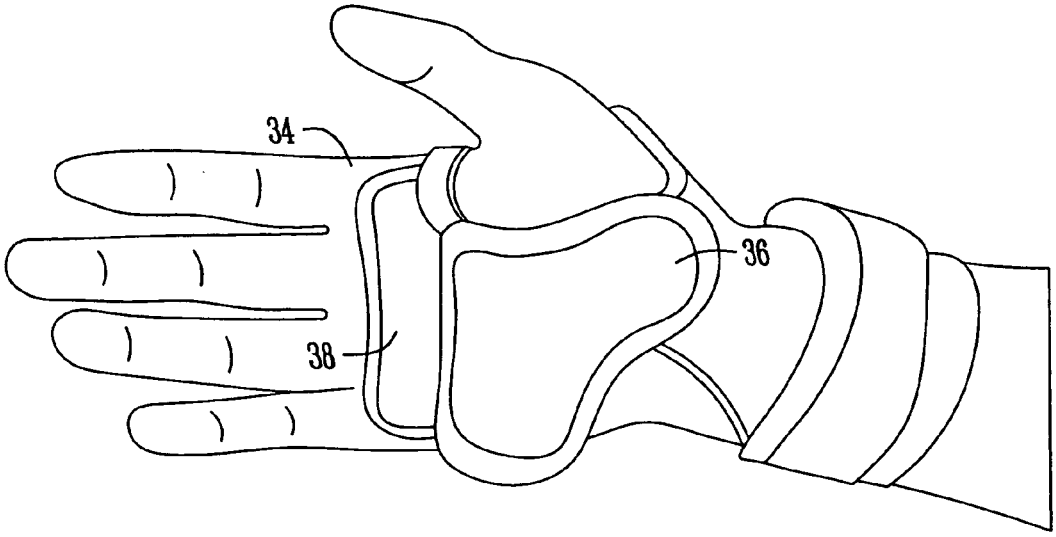
FIG. 5 is a bottom view of a wrist protector of this invention.
Figure 6:
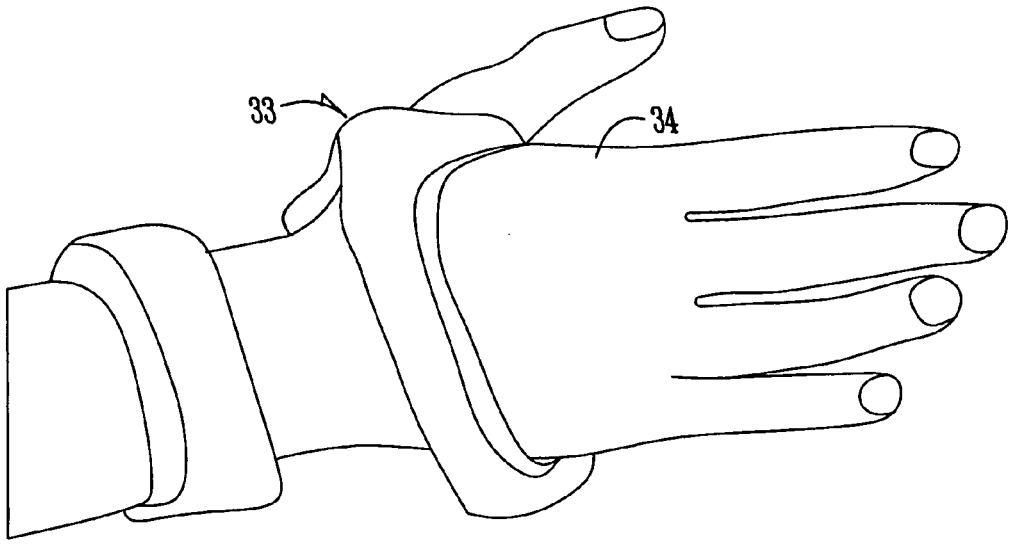
FIG. 6 is a plan view of a wrist protector of this invention.

FIG. 4 shows a conventional wrist protector 32 in perspective view. FIG. 5 shows the bottom view of the wrist protector 33 and in conjunction with a hand 34 to locate where the protector normally has pads 36 and 38 (FIG. 5). These pads 36 and 38 would be filled with viscoelastic polymeric material of the present invention to mimic the trabecular architecture of cancellous bone. FIG. 6 shows a plan view of the wrist protector 32 of FIG. 4.

Figure 7:
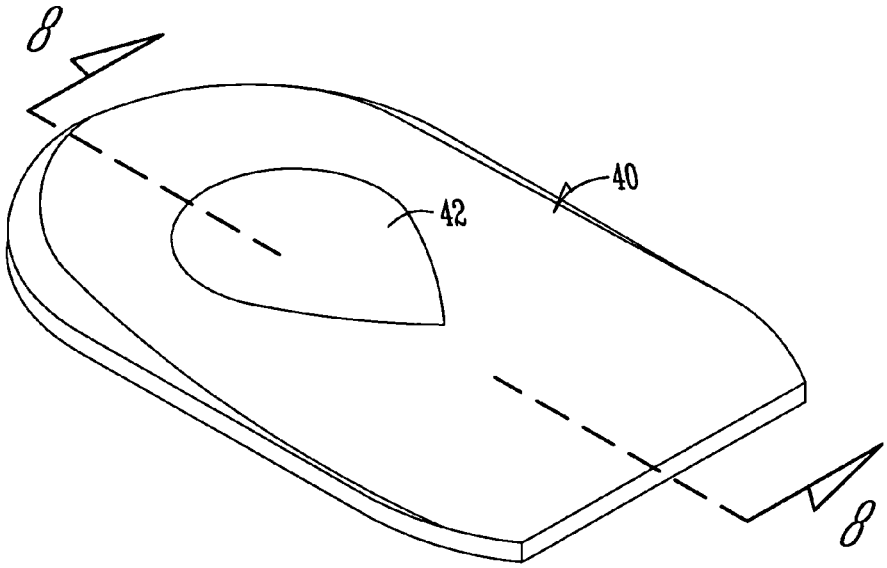
FIG. 7 is a shoe insert which contains a trabecular disk of this invention.
Figure 8:
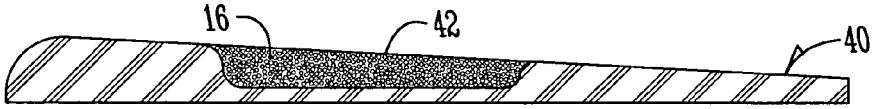
FIG. 8 is a sectional view along line 8-8 of the shoe insert of FIG. 7.
Figure 9:
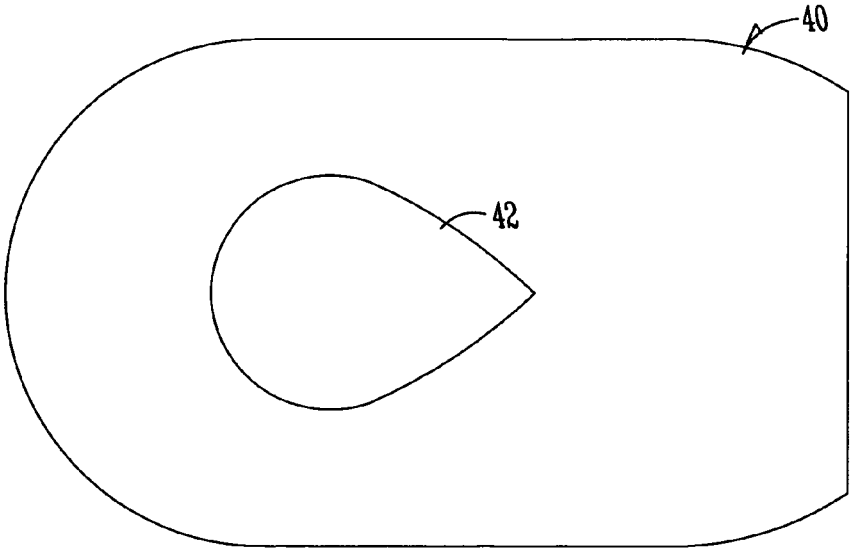
FIG. 9 is a plan view of the shoe protector of FIG. 7.

FIG. 7 shows a shoe insert 40 containing a trabecular matrix disk 42 designed specifically to be underneath a sore point in the human heel for heel cushioning. The result for patients, for example having bone spurs on the heel, is a remarkably superior product of noticeably enhanced comfort. FIG. 9 shows a sectional view of the heel cushion 40 of FIG. 7 taken along line 8-8 difference in architecture of the trabecular disk.

Figure 10:
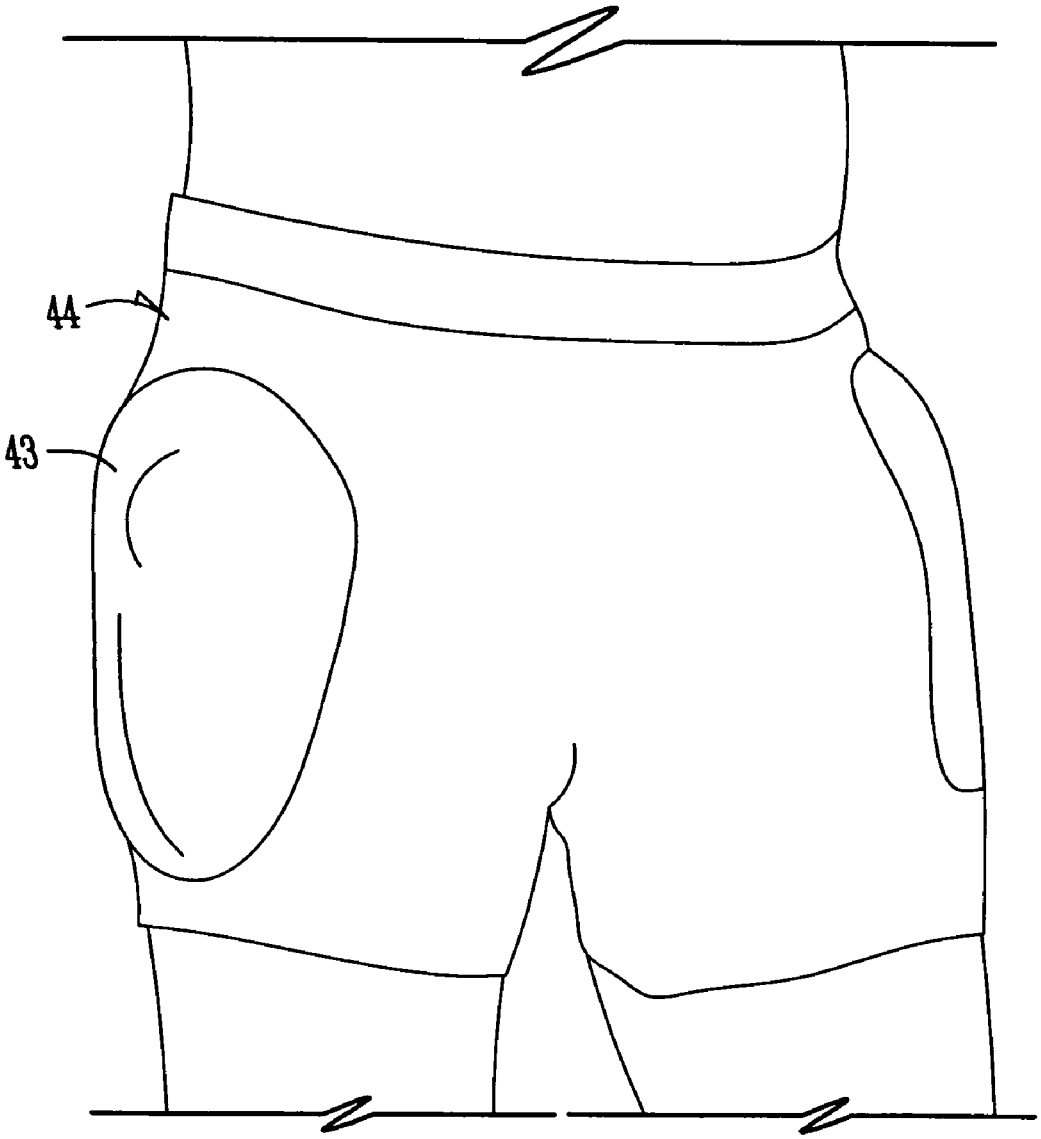
FIG. 10 is a perspective view of a hip pad containing viscoelastic pad architecture in making a hip protector of the present invention.

FIG. 10 shows a perspective of a hip pad 43 on a pair of support pants 44 which could, for example, be worn by the elderly in need of hip protection, or for that matter athletes having a hip injury in need of protection.

In summary, it can be seen that this invention utilizes a new viscoelastic material that mimics the trabecular architecture of cancellous bone for soft goods as a padding material in orthotic devices of wide application. The result is new and dynamic impact response that should enhance protection in a variety of human endeavors. It therefore can be seen that the invention accomplishes all of its stated objectives.

What is claimed is:

1. An impact pad containing orthotic device for cushioning body parts comprising:

a covering pad for placement in close proximity to body parts to be protected; and a compressible viscoelastic organic polymeric material shaped to have random voids defined by walls of polymeric material, which voids and walls together mimic the random but uniform trabecular architecture of cancellous bone and provide a viscoelastic cushioning response to impact forces.

2. The impact pad containing orthotic device of claim 1 wherein the viscoelastic polymeric material is selected from the group consisting of polyvinyl acetates, polyurethanes, polyisocyanates, polystyrenes, polyvinyls and polyalphaolefins.

3. The impact pad containing orthotic device of claim 1 wherein the device is selected from the group consisting of heel cushions, hip pads, bone spur pads, wrist pads, elbow pads, shoulder pads, thigh pads, forearm pads, head protectors, shin protectors, and ankle protectors.

4. The impact pad containing orthotic device of claim 1 wherein the viscoelastic polymeric material is one which has been formed in a mold to provide voids in the polymerized material to mimic the trabecular architecture of cancellous bone.

5. The impact pad containing orthotic device of claim 4 which has the mechanobiology of cancellous bone.

6. A method of forming an organic viscoelastic polymeric material which mimics the trabecular architecture of cancellous bone, comprising:

selecting the desired viscoelastic polymer ingredients;

combining the ingredients in a mold to form the polymerized material;

said mold having a random lattice structure configuration of voids defined by walls of polymeric material to allow the final polymerized polymer shape to mimic the random but uniform trabecular architecture of cancellous bone; and removing the final polymerized material from the mold.

7. The method of claim 6 wherein the viscoelastic polymeric material is selected from the group consisting of polyvinyl-acetates, polyurethanes, polyisocyanates, polystyrenes, polyvinyls and poly-alpha-olefins.

8. The method of claim 7 wherein the formed viscoelastic polymer is placed in an impact pad of an orthotic device for cushioning body parts from impacts.

9. The method of claim 8 wherein the impact pad orthotic device is selected from the group consisting of heel cushions, hip pads, bone spur pads, wrist pads, elbow pads, shoulder pads, thigh pads, forearm pads, head protectors, shin protectors, and ankle protectors.

10. An impact pad containing orthotic device for cushioning body parts consisting essentially of:

a covering pad for placement in close proximity to body parts to be protected; and a molded compressible viscoelastic organic polymerized material having a random lattice structure of voids configured within the pad so that the final organic polymerized molded polymer shape mimics the trabecular architecture of cancellous bone and provides a viscoelastic response to impact.

11. The orthotic device of claim 10 wherein the viscoelastic organic polymeric material is selected from the group consisting of polyvinyl acetates polyurethanes, polyisocyanates, polystyrenes, polyvinyls and polyalphaolefins.

12. The orthotic device of claim 10 wherein the device is selected from the group consisting of heel cushions, hip pads, bone spur pads, wrist pads, elbow pads, shoulder pads, thigh pads, forearm pads, head protectors, shin protectors, and ankle protectors.

13. The orthotic device of claim 10 which includes a random lattice structure in the organic polymerized material.

14. The orthotic device of claim 10 wherein the viscoelastic organic polymeric material is one which has been formed in a mold to provide voids in the polymerized material to mimic the trabecular architecture of cancellous bone.

15. The impact pad of claim 1 shaped to have voids, plates and struts.

16. The impact pad of claim 10 shaped to have random voids, plates and struts.

* * * * *